US011503884B2

(12) United States Patent
Xue et al.

(10) Patent No.: US 11,503,884 B2
(45) Date of Patent: Nov. 22, 2022

(54) MOUNTING AND LOCKING MECHANISM, CASING, AND WEARABLE DEVICE

(71) Applicant: GUANGDONG OPPO MOBILE TELECOMMUNICATIONS CORP., LTD., Guangdong (CN)

(72) Inventors: Yuege Xue, Guangdong (CN); Jianghua Hu, Guangdong (CN)

(73) Assignee: GUANGDONG OPPO MOBILE TELECOMMUNICATIONS CORP., LTD., Guangdong (CN)

( * ) Notice: Subject to any disclaimer, the term of this patent is extended or adjusted under 35 U.S.C. 154(b) by 203 days.

(21) Appl. No.: 16/927,340

(22) Filed: Jul. 13, 2020

(65) Prior Publication Data

US 2021/0015220 A1 Jan. 21, 2021

(30) Foreign Application Priority Data

Jul. 15, 2019 (CN) ..... 201910635893.X
Jul. 15, 2019 (CN) ..... 201921102464.8

(51) Int. Cl.
*A44C 5/14* (2006.01)

(52) U.S. Cl.
CPC ..... *A44C 5/147* (2013.01)

(58) Field of Classification Search
CPC ..... A44C 5/14; A44C 5/145; A44C 5/147
See application file for complete search history.

(56) References Cited

U.S. PATENT DOCUMENTS 6,014,793 A * 1/2000 Howald ..... A44C 5/147 24/265 B
2014/0353349 A1* 12/2014 De Oliveira ..... G04B 37/1486 224/164

(Continued)

FOREIGN PATENT DOCUMENTS

CN 202819884 3/2013
CN 204511066 7/2015

(Continued)

OTHER PUBLICATIONS

IPI, Office Action for IN Application No. 202014029331, dated Jul. 29, 2021.

(Continued)

*Primary Examiner* — Jack W Lavinder
(74) *Attorney, Agent, or Firm* — Hodgson Russ LLP

(57) ABSTRACT

A mounting and locking mechanism, a casing, and a wearable device are provided. The mounting and locking mechanism includes a mounting bracket and a locking assembly. The mounting bracket is provided with a mounting space including a first insertion slot and an accommodation slot. The accommodation slot has a first slot wall provided with a first opening communicating with the first insertion slot. The locking assembly includes a movable member and a first locking member. The movable member is received in the accommodation slot. The movable member is movable between a first position and a second position. In the first position, the movable member abuts the first locking member to drive part of the first locking member to pass through the first opening to be positioned in the first insertion slot. In the second position, the first locking member can be withdrawn from the first insertion slot.

20 Claims, 11 Drawing Sheets

(56) References Cited

U.S. PATENT DOCUMENTS

| | | | |
|---|---|---|---|
| 2015/0107299 | A1 | 4/2015 | Knuchel |
| 2018/0084873 | A1 | 3/2018 | Kallman et al. |
| 2019/0064744 | A1 | 2/2019 | Nicolas et al. |

FOREIGN PATENT DOCUMENTS

| | | |
|---|---|---|
| CN | 207055005 | 3/2018 |
| CN | 207236300 | 4/2018 |
| CN | 210015333 | 2/2020 |
| DE | 202010013569 | 2/2011 |
| EP | 2476334 | 7/2012 |
| FR | 2742638 | 6/1997 |
| JP | S5698013 | 8/1981 |
| WO | 2017195054 | 11/2017 |

OTHER PUBLICATIONS

WIPO, English translation of the ISR and WO for PCT/CN2020/097285, dated Sep. 23, 2020.
Extended European Search Report for EP Application No. 20181337.5 dated Dec. 17, 2020.

* cited by examiner

MOUNTING AND LOCKING MECHANISM, CASING, AND WEARABLE DEVICE

CROSS-REFERENCE TO RELATED APPLICATIONS

This application claims priority to Chinese Patent Application Serial Nos. 201910635893.X, and 201921102464.8, each filed on Jul. 15, 2019, the entire disclosures of which are incorporated herein by reference.

TECHNICAL FIELD

The present disclosure relates to the technical field of wearable devices, and in particular, to a mounting and locking mechanism, a casing, and a wearable device.

BACKGROUND

In related technology, a band of a wearable device, such as a smart watch or a smart bracelet, is detachably connected to a dial of the wearable device. For example, the band can be connected to the dial by a snap-in member, such as an elastic pin. In this way, when the band is damaged and needs to be repaired and replaced, a user can detach the band from the dial. However, it is difficult to detach and attach snap-in members such as an elastic pin, which are used for connecting the band and the dial. As a result, it can be difficult and inefficient to detach and attach a band and dial

SUMMARY

According to a first embodiment of the present disclosure, a mounting and locking mechanism is provided.

The mounting and locking mechanism can include a mounting bracket and a locking assembly. The mounting bracket can be provided with a mounting space. The mounting space includes a first insertion slot and an accommodation slot. The accommodation slot has a first slot wall. The first slot wall can be provided with a first opening communicating with the first insertion slot. The locking assembly includes a movable member and a first locking member. The movable member can be received in the accommodation slot. The first locking member can contact the first slot wall. The movable member is movable between a first position and a second position. When the movable member is in the first position, the movable member may abut the first locking member to drive part of the first locking member to pass through the first opening to be positioned in the first insertion slot. When the movable member is in the second position, the first locking member can be withdrawn from the first insertion slot.

According to a second embodiment of the present disclosure, a casing is provided.

The casing can include a main body and a mounting and locking mechanism. The mounting and locking mechanism can include a mounting bracket and a locking assembly. The mounting bracket can be provided with a mounting space. The mounting space can include a first insertion slot and an accommodation slot. The accommodation slot can have a first slot wall. The first slot wall may be provided with a first opening communicating with the first insertion slot. The locking assembly includes a movable member and a first locking member. The movable member is received in the accommodation slot. The first locking member can contact the first slot wall. The movable member is movable between a first position and a second position. When the movable member is in the first position, the movable member can abut the first locking member to drive part of the first locking member to pass through the first opening to be positioned in the first insertion slot. When the movable member is in the second position, the first locking member can be withdrawn from the first insertion slot. The mounting bracket is attached to the main body, and a movement direction of the movable member is parallel to a thickness direction of the main body.

According to a third embodiment of the present disclosure, a wearable device is provided.

The wearable device can include a casing and a band including a band body and a first insertion member attached to one end of the band body. The casing can include a main body and a mounting and locking mechanism. The mounting and locking mechanism can include a mounting bracket and a locking assembly. The mounting bracket can be provided with a mounting space. The mounting space includes a first insertion slot and an accommodation slot. The accommodation slot can have a first slot wall. The first slot wall can be provided with a first opening communicating with the first insertion slot. The locking assembly includes a movable member and a first locking member. The movable member is received in the accommodation slot. The first locking member can contact the first slot wall. The movable member is movable between a first position and a second position. The mounting bracket is attached to the main body, and a movement direction of the movable member is parallel to a thickness direction of the main body. The first insertion member is provided with a first locking slot, and the first insertion member can be attached to the mounting bracket. When the movable member is in the first position, the movable member abuts the first locking member to drive part of the first locking member to pass through the first opening to be positioned in the first insertion slot and to drive the first locking member be positioned in the first locking slot. When the movable member is in the second position, the first insertion member can be detached from the mounting bracket, the first locking member can be withdrawn from the first insertion slot.

According to a fourth embodiment of the present disclosure, a wearable device is provided.

The wearable device includes a main body, a band, and a locking assembly. The band includes a band body and a first insertion member attached to one end of the band body. The first insertion member is provided with a first locking slot, and the first insertion member can be inserted into the main body in a length direction of the band. The locking assembly includes a movable member and a first locking member. The movable member is attached to the main body and is movable between a first position and a second position in a thickness direction of the band. When the movable member is in the first position, the movable member abuts the first locking member to drive the first locking member to be positioned in the first locking slot. When the movable member is in the second position, the first locking member can be withdrawn from the first locking slot such that the first locking member can be detached from the main body.

BRIEF DESCRIPTION OF THE DRAWINGS

For a fuller understanding of the nature and objects of the disclosure, reference should be made to the accompanying drawings and the subsequent description. Those skilled in the art may obtain other accompanying drawings according to the description accompanying drawings without creative effort.

DETAILED DESCRIPTION

Figure 1:
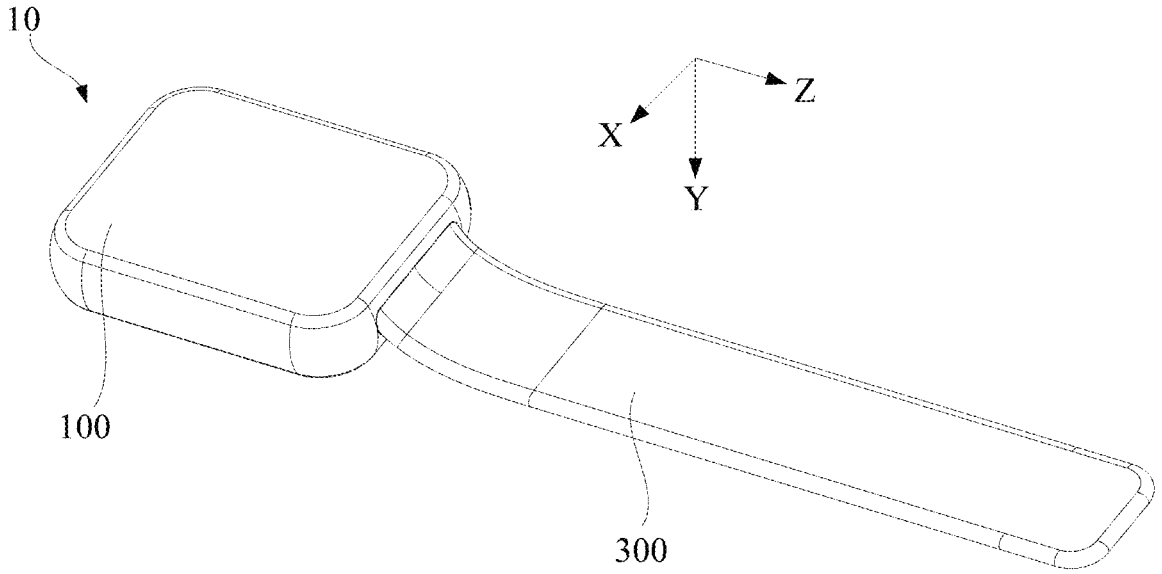
FIG. 1 is a schematic structural view of a wearable device according to an embodiment of the present disclosure.

In order to facilitate understanding of the present disclosure, the present disclosure will be described completely with reference to the accompanying drawings. The accompanying drawings illustrate certain embodiments of the present disclosure. However, the present disclosure can be implemented in many different forms and is not limited to the embodiments described herein. The present disclosure can be more thoroughly and comprehensively understood through these embodiments provided.

A mounting and locking mechanism includes a mounting bracket and a locking assembly. The mounting bracket is provided with a mounting space. The mounting space includes a first insertion slot and an accommodation slot. The accommodation slot has a first slot wall. The first slot wall is provided with a first opening communicating with the first insertion slot. The locking assembly includes a movable member and a first locking member. The movable member is received in the accommodation slot. The first locking member can contact the first slot wall. The movable member can be moved between a first position and a second position. When the movable member is in the first position, the movable member abuts the first locking member to drive part of the first locking member to pass through the first opening to be positioned in the first insertion slot. When the movable member is in the second position, the first locking member can be withdrawn from the first insertion slot.

A casing includes a main body and a mounting and locking mechanism. The mounting and locking mechanism includes a mounting bracket and a locking assembly. The mounting bracket is provided with a mounting space. The mounting space includes a first insertion slot and an accommodation slot. The accommodation slot has a first slot wall. The first slot wall is provided with a first opening communicating with the first insertion slot. The locking assembly includes a movable member and a first locking member. The movable member is received in the accommodation slot. The first locking member can contact the first slot wall. The movable member can be moved between a first position and a second position. When the movable member is in the first position, the movable member abuts the first locking member to drive part of the first locking member to pass through the first opening to be positioned in the first insertion slot. When the movable member is in the second position, the first locking member can be withdrawn from the first insertion slot. The mounting bracket is attached to the main body, and a movement direction of the movable member is parallel to a thickness direction of the main body.

A wearable device includes a casing and a band including a band body and a first insertion member attached to one end of the band body. The casing includes a main body and a mounting and locking mechanism. The mounting and locking mechanism includes a mounting bracket and a locking assembly. The mounting bracket is provided with a mounting space. The mounting space includes a first insertion slot and an accommodation slot. The accommodation slot has a first slot wall. The first slot wall is provided with a first opening communicating with the first insertion slot. The locking assembly includes a movable member and a first locking member. The movable member is received in the accommodation slot. The first locking member can contact the first slot wall. The movable member is movable between a first position and a second position. The mounting bracket is attached to the main body, and a movement direction of the movable member is parallel to a thickness direction of the main body. The first insertion member is provided with a first locking slot, and the first insertion member can be attached to the mounting bracket. When the movable member is in the first position, the movable member abuts the first locking member to drive part of the first locking member to pass through the first opening to be positioned in the first insertion slot and to drive the first locking member be positioned in the first locking slot. When the movable member is in the second position, the first insertion member can be detached from the mounting bracket, the first locking member can be withdrawn from the first insertion slot.

A wearable device includes a main body, a band, and a locking assembly. The band includes a band body and a first insertion member attached to one end of the band body. The first insertion member is provided with a first locking slot, and the first insertion member can be inserted into the main body in a length direction of the band. The locking assembly includes a movable member and a first locking member. The movable member is attached to the main body and is movable between a first position and a second position in a thickness direction of the band. When the movable member is in the first position, the movable member abuts the first locking member to drive the first locking member to be positioned in the first locking slot. When the movable member is in the second position, the first locking member can be withdrawn from the first locking slot such that the first locking member can be detached from the main body.

Figure 4:
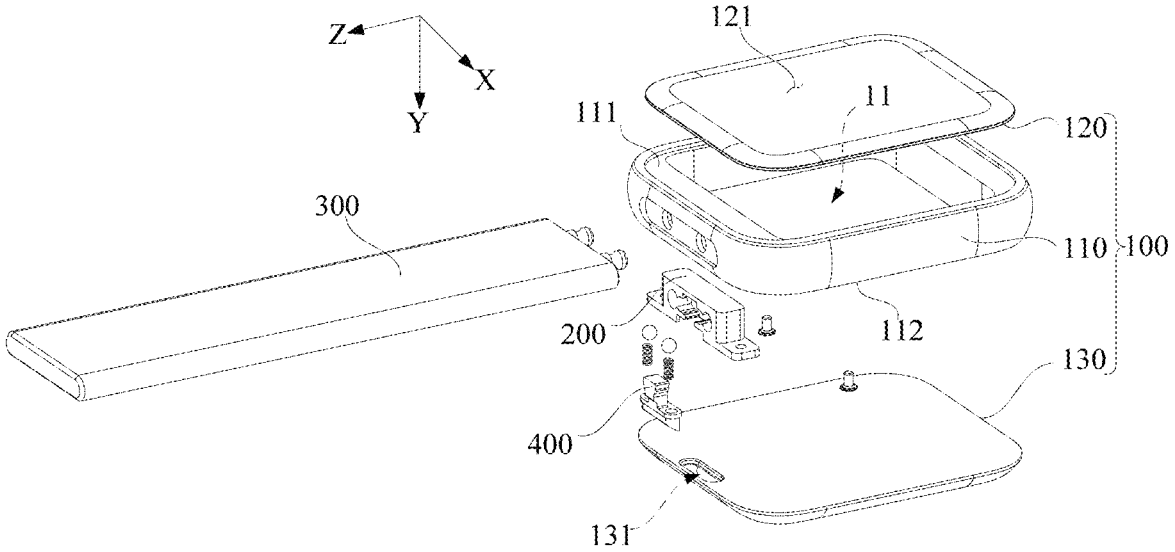
FIG. 4 is an exploded view of the wearable device in FIG. 1.

As illustrated in FIGS. 1 and 4, in an embodiment, a wearable device 10 is described, by way of example, a watch including a smart watch and a mechanical watch. The wearable device 10 includes a main body 100, a mounting bracket 200 operated to be attached to the main body 100, a band 300 operated to be attached to the mounting bracket 200, and a locking assembly 400 operated to be attached to the mounting bracket 200 and to lock the band 300 to the mounting bracket 20. It can be understood that, in other embodiments, the wearable device 10 can also be a smart bracelet or a smart armband and the present disclosure is not limited thereto.

Figure 2:
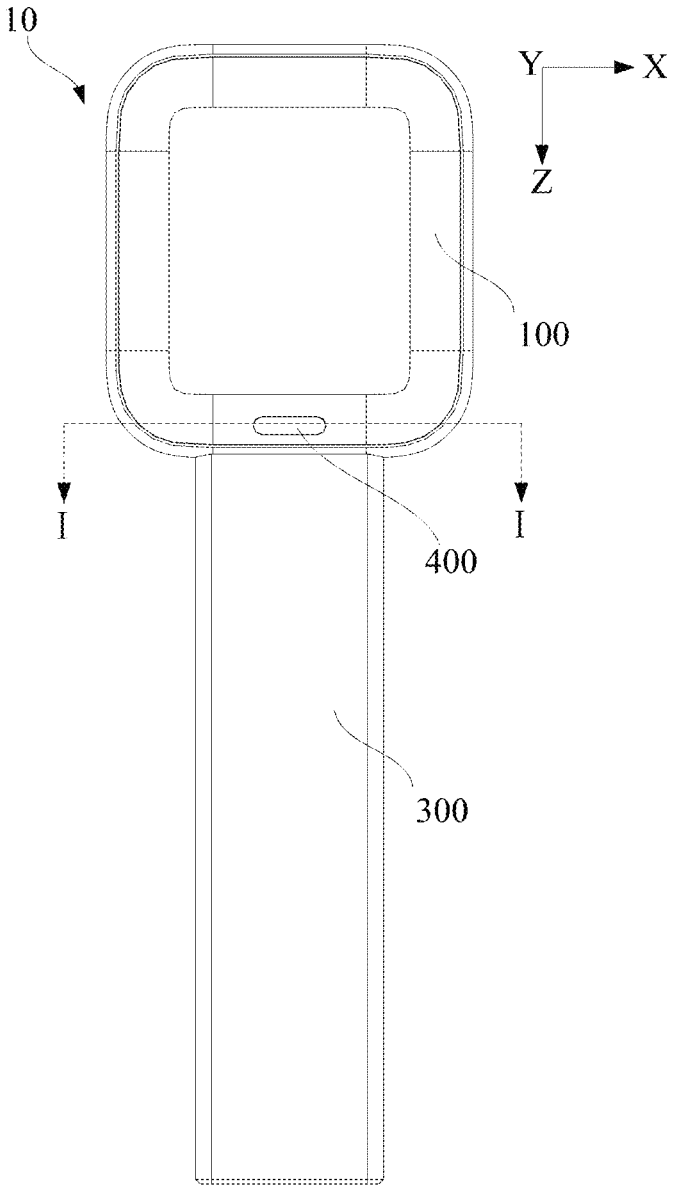
FIG. 2 is a bottom view of the wearable device in FIG. 1.
Figure 3:
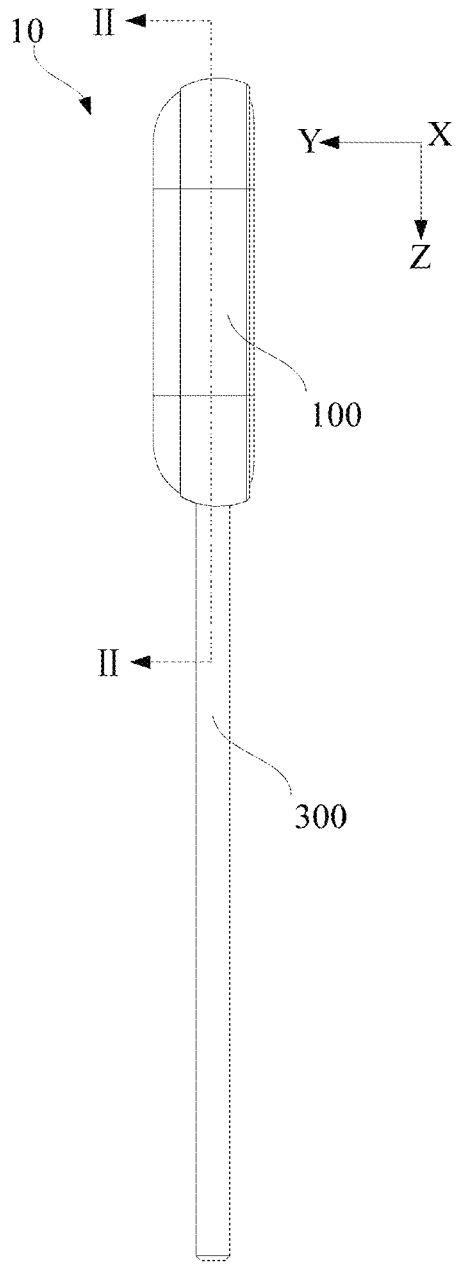
FIG. 3 is a side view of the wearable device in FIG. 1.

FIGS. 1 to 3 illustrate that the band 300 is attached to one side of the main body 100 and is fixed in the mounting bracket 200 via the locking assembly 400 according to an embodiment of the present disclosure. Of course, another band 300 can be attached to the other side of the main body 100 via a lock assembly 400. Thus, with the cooperation of the two bands 300, a user can wear the wearable device 10 such as a watch.

In an embodiment, as illustrated in FIG. 4, the main body 100 includes a middle frame 110, a display screen 120, and a rear cover 130. The display screen 120 and the rear cover 130 are respectively attached to two opposite sides of the middle frame 110, thereby defining a receiving cavity 11. In an embodiment, the middle frame 110 has a first side 111 and a second side 112 opposite to the first side 111. The display screen 120 includes a display surface 121. A side of the display screen 120 away from the display surface 121 is attached to the first side 111 of the middle frame 110. Accordingly, the rear cover 130 is attached to the second side 112 of the middle frame 110, that is, the rear cover 130 faces away from the display surface 121 of the display screen 120. It can be understood that, in other embodiments, the display screen 120 may be omitted, for example, when the wearable device 10 is a mechanical watch rather than a smart watch.

Figure 5:
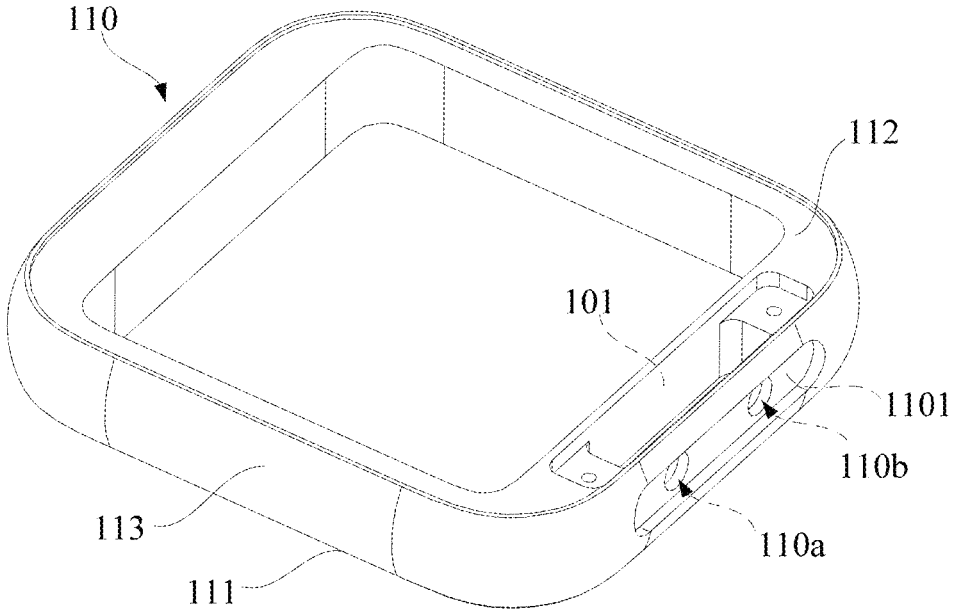
FIG. 5 is a schematic structural view of a middle frame in FIG. 4.
Figure 6:
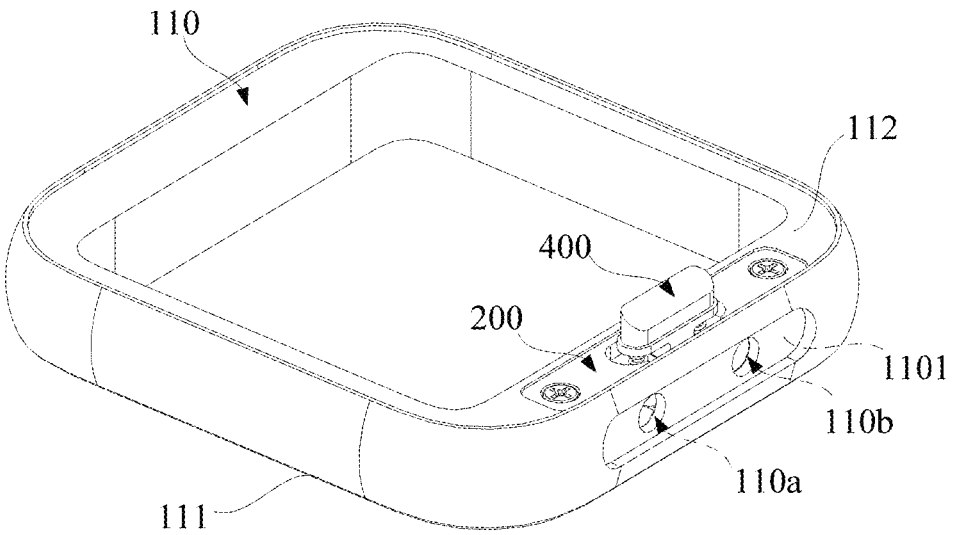
FIG. 6 is a schematic structural view of a mounting and locking mechanism in FIG. 4 attached to the middle frame.

In an embodiment, the mounting bracket 200 is detachably attached to the main body 100. As illustrated in FIGS. 5 and 6, the main body 100 is provided with a receiving space 101. In an embodiment, the receiving space 101 is T-shaped and defined in the middle frame 110 and extends through the second side 112. The mounting bracket 200 is received in the receiving space 101. After being received in the receiving space 101, the mounting bracket 200 can be fixed in the middle frame 110, such as by fasteners such as threaded members engaging with the bars of the mounting bracket 200 and the middle frame 110. It can be understood that, in other embodiments, the mounting bracket 200 and the main body 100 are integrally formed. For example, the mounting bracket 200 and the middle frame 110 can be integrally formed, that is, the mounting bracket 200 may be a component of the main body 100. The band 300 can be attached to the mounting bracket 200, that is, the band 300 can be attached to the main body 100.

Figure 7:
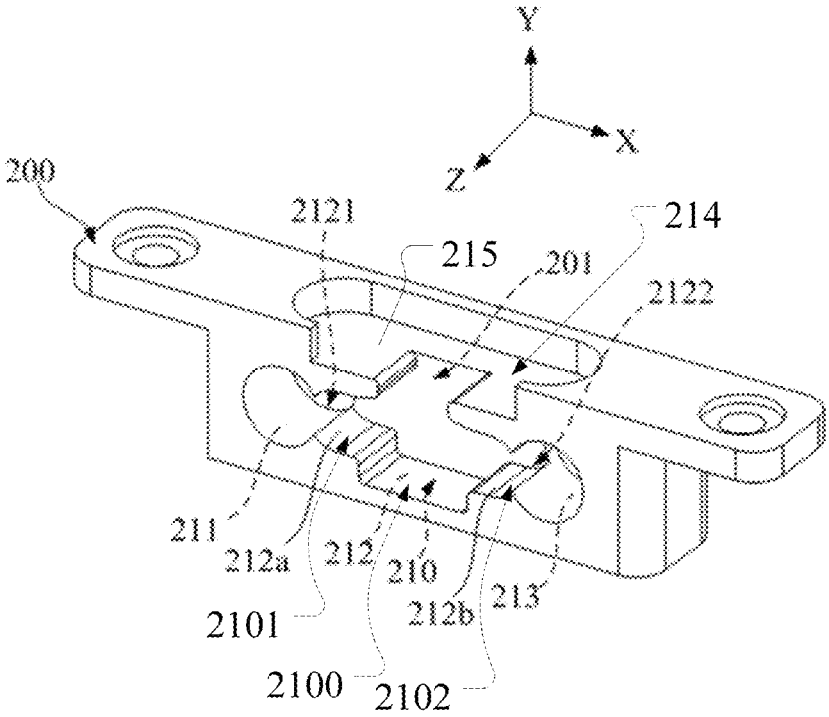
FIG. 7 is a schematic structural view of a mounting bracket in FIG. 4.

In an embodiment, as illustrated in FIG. 7, the mounting bracket 200 is T-shaped, and includes a main part and a pair of tabs from an outside of an upper portion of the main part extending in opposite directions. The mounting bracket 200 is provided with a mounting space 210 in a lower portion of the main part of the mounting bracket 200, a recessed portion 214 in the upper portion of the main part of the mounting bracket 200, and a platform 215 between the mounting space 210 and the recessed portion 214. In an embodiment, the mounting space 210 can include a first insertion slot 211, an accommodation slot 212, and a second insertion slot 213 that are sequentially communicated with each other. The accommodation slot 212 includes a middle slot portion 2100, a first slot portion 2101 and a second slot portion 2102 located beside the middle slot portion 2100. The first insertion slot 211 and the first slot portion 2101 of the accommodation slot 212 may communicate with each other in a first direction, and the second insertion slot 213 and the second slot portion 2102 of the accommodation slot 212 may communicate with each other in the first direction. The first direction refers to a width direction of the band 300, that is, the X-axis direction illustrated in the figures, such as, FIGS. 4, 7-9, and 11-18. It can be understood that, in other embodiments, the first direction may form an angle within a tolerance range with respect to the width direction of the band 300. In an embodiment, as illustrated in FIGS. 5 and 6, the middle frame 110 includes a peripheral side 113 disposed between the first side 111 and the second side 112. The middle frame 110 is provided with a first through hole **110*a* and a second through hole 110*b* communicating with the receiving space 101 and extending through the peripheral side 113. When the mounting bracket 200 is mounted in the receiving space 101, the first through hole 110*a* communicates with the first insertion slot 211, and the second through hole 110*b* communicates with the second insertion slot 213. In an embodiment, a recessed portion 1101 is defined in the peripheral side 113 of the middle frame 110 corresponding to the receiving space 101. The first through hole 110*a* and the second through hole 110*b* are spaced apart from each other in the first direction, that is, the width direction of the band 300, and extend through a bottom of the recessed portion 1101. Unless otherwise specified, the first direction is the width direction of the band 300**.

Figure 8:
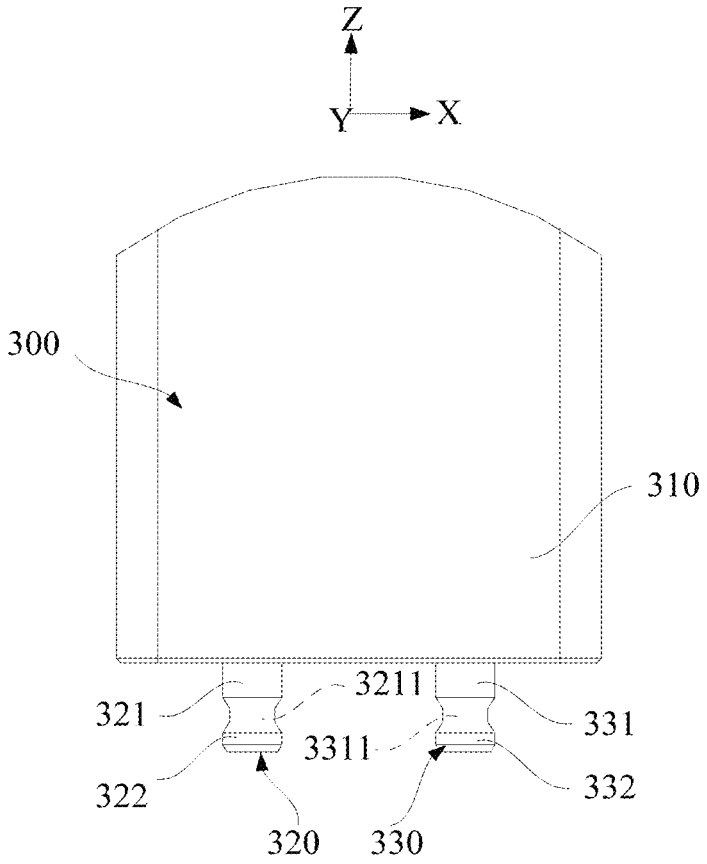
FIG. 8 is a partially schematic view of a band in FIG. 4.

In an embodiment, as illustrated in FIG. 8, the band 300 can include a band body 310, a first insertion member 320, and a second insertion member 330. The first insertion member 320 and the second insertion member 330 are disposed at the same end of the band body 310. The first insertion member 320 and the second insertion member 330 are spaced apart from each other in the first direction, that is, the width direction of the band 300.

The first insertion member 320 includes a first insertion body 321 connected to the band body 310, and a first insertion end 322 connected to an end of the first insertion body 321 away from the band body 310. At least part of the first insertion body 321 has a width less than that of the first insertion end 322. For example, in an embodiment, the first insertion body 321 can be provided with a first locking slot 3211, and a portion of the first insertion body 321 where the first locking slot 3211 is located has a width less than the width of the first insertion end 322. In another example, in an embodiment, when the first insertion body 321 and the first insertion end 322 both are rod-shaped, the first insertion body 321 has a diameter less than that of the first insertion end 322. In addition, the first insertion member 320 can be inserted into the mounting space 210 in a length direction of the band 300. In an embodiment, the first insertion member 320 can be inserted into the first insertion slot 211 via the first through hole **110*a* in the length direction of the band 300**.

The second insertion member 330 includes a second insertion body 331 connected to the band body 310, and a second insertion end 332 connected to an end of the second insertion body 331 away from the band body 310. At least part of the second insertion body 331 has a width less than that of the second insertion end 332. For example, in an embodiment, the second insertion body 331 is provided with a second locking slot 3311, and a portion of the second insertion body 331 where the second locking slot 3311 is located has a width less than the width of the second insertion end 332. According to another example, when the second insertion body 331 and the second insertion end 332 both are rod-shaped, the second insertion body 331 has a diameter less than that of the second insertion end 332. The second insertion member 330 can be inserted into the mounting space 210 in the length direction of the band 300. In an embodiment, the second insertion member 330 can be inserted into the second insertion slot 213 via the second through hole 110*b* in the length direction of the band 300.

Figure 9:
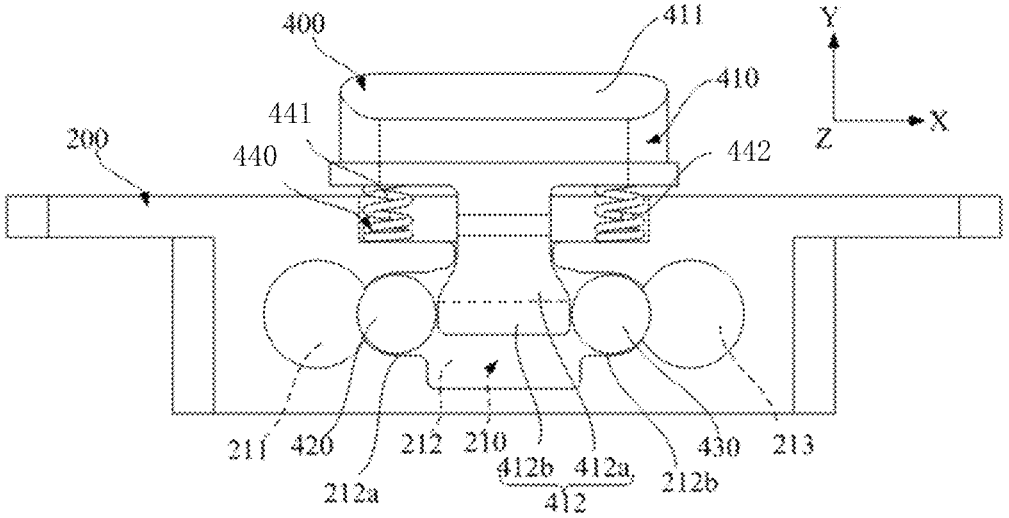
FIG. 9 is a schematic structural view of the mounting and locking mechanism in FIG. 6.

As illustrated in FIG. 9, the locking assembly 400 can be attached to the mounting bracket 200. In an embodiment, when received in the accommodation slot 212, the locking assembly 400 can fix the first insertion member 320 inserted into the first insertion slot 211 in the mounting bracket 200, and can also fix the second insertion member 330 inserted into the second insertion slot 213 in the mounting bracket 200. That is, after the mounting bracket 200 is mounted in the receiving space 101, the end of the band 300 provided with the first insertion member 320 and the second insertion member 330 can be fixed in the main body 100. The locking assembly 400 and the mounting bracket 200 can form a mounting and locking mechanism that can be individually manufactured, assembled, and applied to the wearable device 10.

In an embodiment, the locking assembly 400 includes a movable member 410, a first locking member 420, and a second locking member 430. The movable member 410 is received in the middle slot portion 2100 of the accommodation slot 212 and movable in a second direction, that is, the Y-axis direction illustrated in the figures, such as, FIGS. 4, 7-9, and 11-18. The second direction may be parallel to a thickness direction of the main body 100. In an embodiment, the second direction is perpendicular to the first direction, that is, a movement direction of the movable member 410 is perpendicular to the width direction of the band 300. The first locking member 420 is received in the first slot portion 2101 of the accommodation slot 212 and the second locking member 430 is received in the second slot portion 2102 of the accommodation slot 212.

In an embodiment, the movable member 410 can move between a first position and a second position in the second direction.

Figure 11:
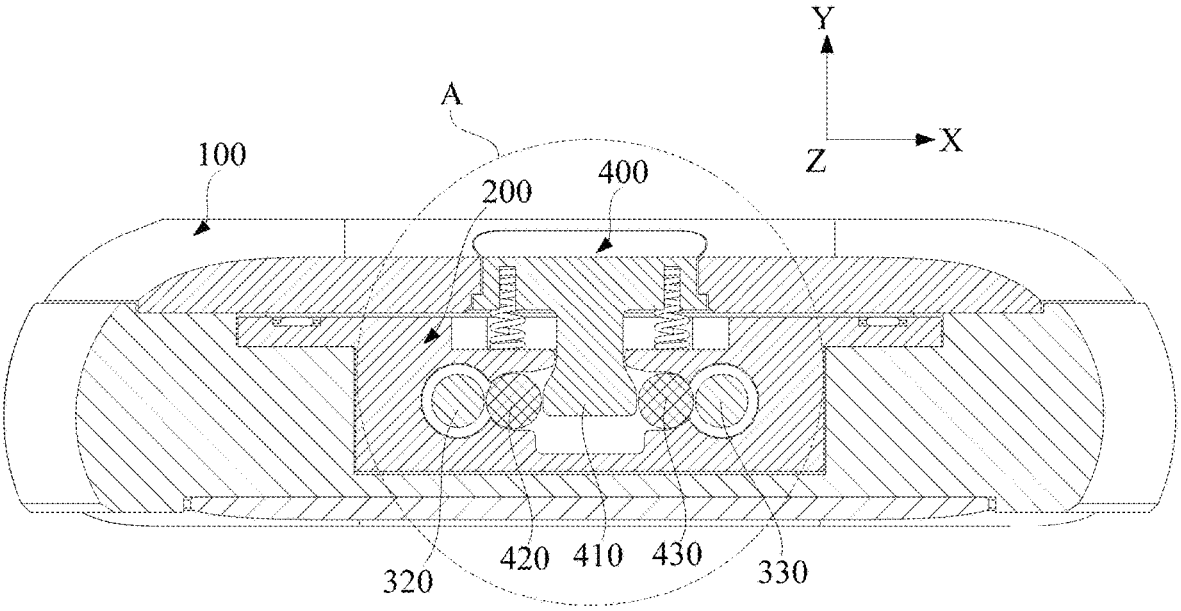
FIG. 11 is a cross-sectional view of the wearable device in FIG. 2 along a line I-I when the movable member is in a first position.
Figure 12:
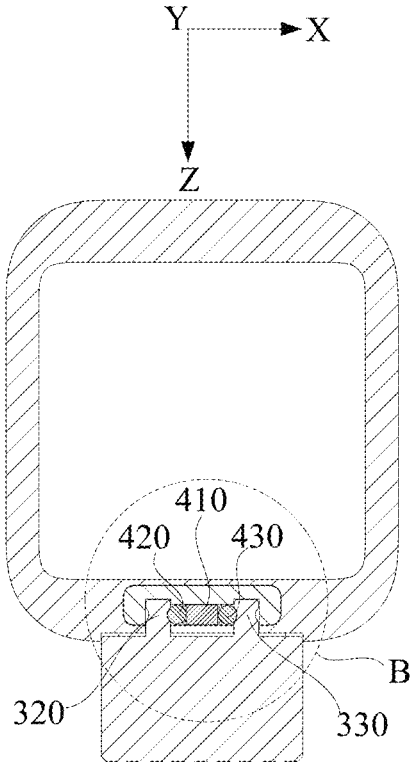
FIG. 12 is a cross-sectional view of the wearable device in FIG. 3 along a line II-II when the movable member is in the first position.

As illustrated in FIGS. 11 and 12, when the movable member 410 is in the first position, the first locking member 420 is clamped between the movable member 410 and the first insertion member 320, and the second locking member 430 is clamped between the movable member 410 and the second insertion member 330.

Figure 13:
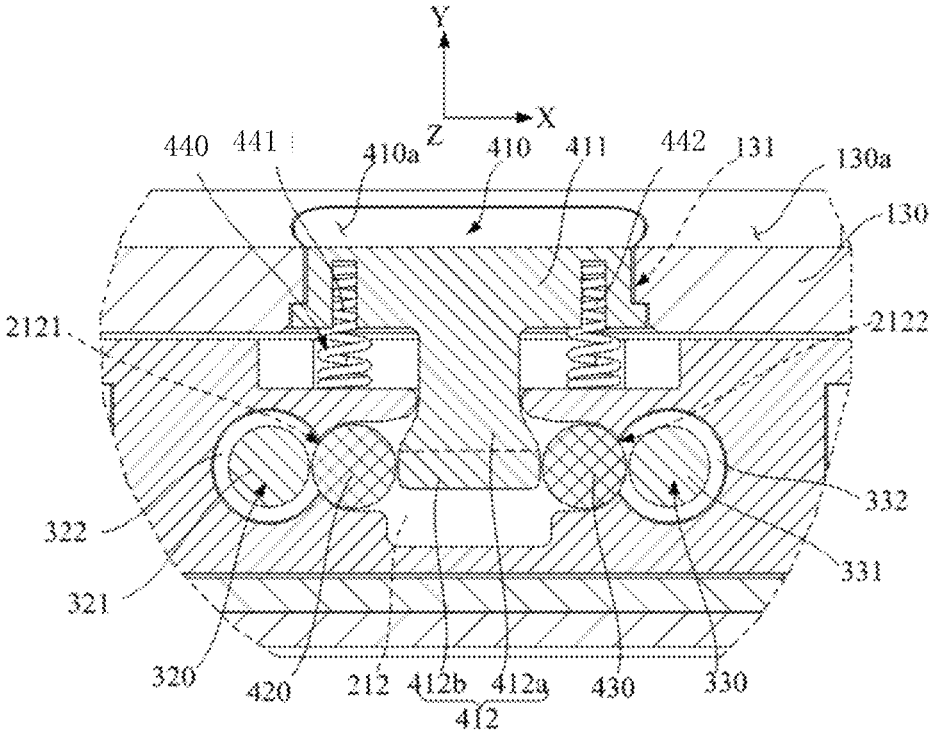
FIG. 13 is an enlarged structural schematic view of a portion A in FIG. 11.
Figure 14:
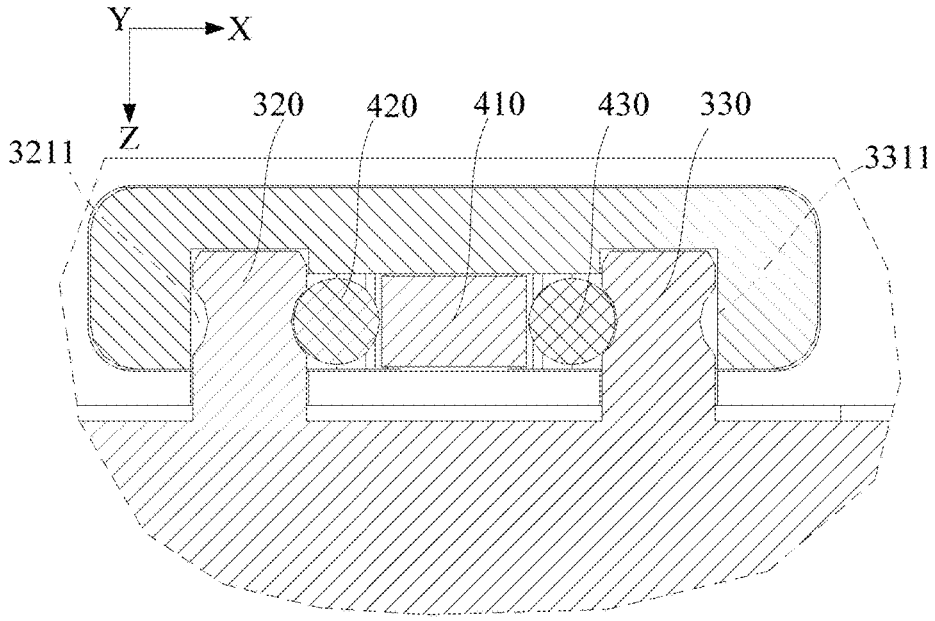
FIG. 14 is an enlarged structural schematic view of a portion B in FIG. 12.

As illustrated in FIG. 13, a projection of the first locking member 420 on a reference plane partially overlaps a projection of the first insertion end 322 on the reference plane, and a projection of the second locking member 430 on the reference plane partially overlaps a projection of the second insertion end 332 on the reference plane. The reference plane is a plane perpendicular to a third direction, that is, the Z-axis. In other words, the third direction is the length direction of the band 300. In an embodiment, as illustrated in FIG. 14, when the movable member 410 is in the first position, the first locking member 420 is urged by the movable member 410 to engage in the first locking slot 3211 of the first insertion body 321, and the second locking member 430 is urged by the movable member 410 to engage in the second locking slot 3311 of the second insertion body 331.

With regard to the wearable device 10, when the movable member 410 is in the first position, the first locking member 420 blocks the first insertion end 322 inserted into the mounting bracket 200 so as to prevent the first insertion member 320 from quitting/withdrawing from the first insertion slot 211. Therefore, the first insertion member 320 can be fixed in the first insertion slot 211 via the first locking member 420. Similarly, the second locking member 430 blocks the second insertion end 332 inserted into the mounting bracket 200 so as to prevent the second insertion member 330 from quitting/withdrawing from the second insertion slot 213. Therefore, the second insertion member 330 can be fixed in the second insertion slot 213 via the second locking member 430.

Figure 15:
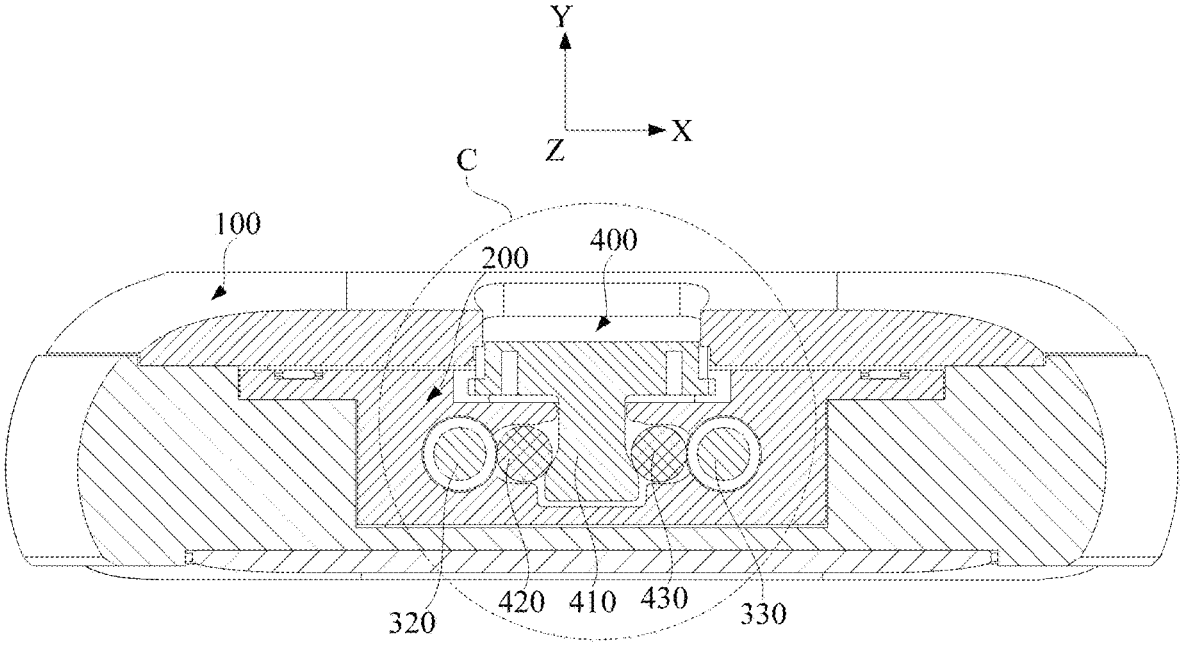
FIG. 15 is a cross-sectional view of the wearable device in FIG. 2 along the line I-I when the movable member is in a second position.
Figure 16:
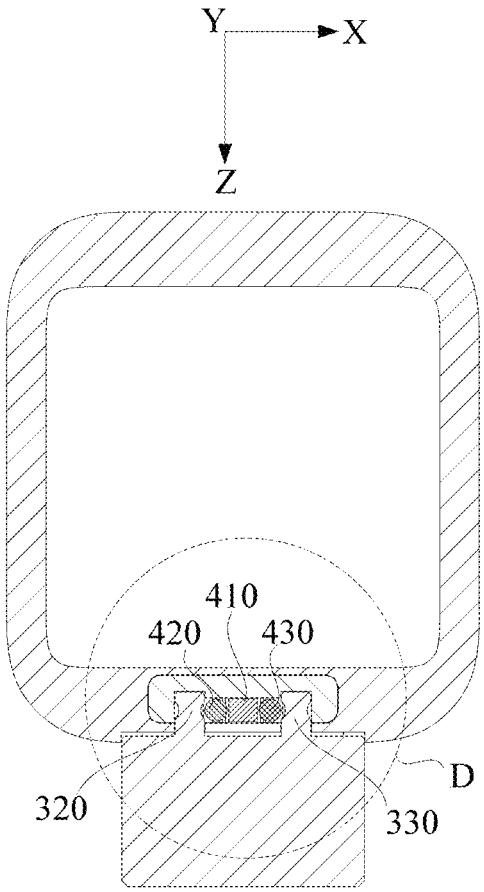
FIG. 16 is a cross-sectional view of the wearable device in FIG. 3 along the line II-II when the movable member is in the second position.
Figure 17:
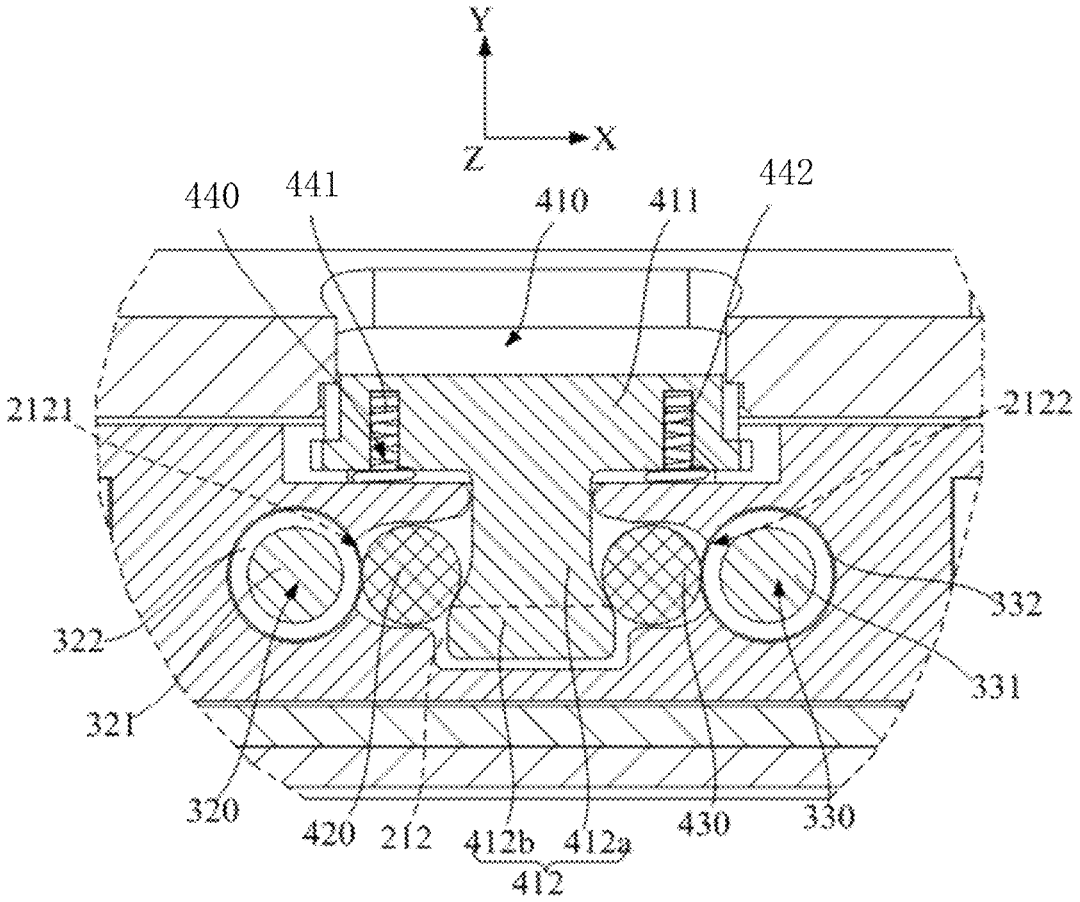
FIG. 17 is an enlarged structural view of a portion C in FIG. 15.

As illustrated in FIGS. 15 and 16, when the movable member 410 is in the second position, the first locking member 420 can disengage from the first insertion member 320 so as to allow the first insertion member 320 to be detached from the main body 100, and the second locking member 430 can disengage from the second insertion member 330 so as to allow the second insertion member 330 to be detached from the main body 100. As illustrated in FIG. 17, at this time, the projection of the first locking member 420 on the reference plane does not overlap with the projection of the first insertion end 322 on the reference plane. That is, the first locking member 420 does not block the first insertion end 322. At the same time, the projection of the second locking member 430 on the reference plane does not overlap with the projection of the second insertion end 332 on the reference plane, that is, the second locking member 430 does not block the second insertion end 332.

Figure 18:
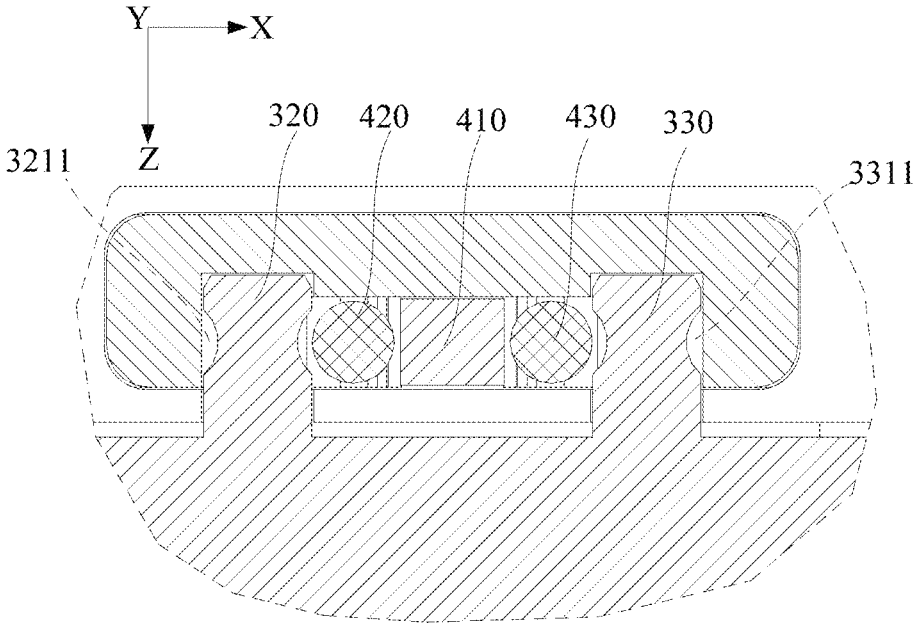
FIG. 18 is an enlarged structural schematic view of a portion D in FIG. 16.

In an embodiment, as illustrated in FIG. 18, when the movable member 410 is in the second position, the first locking member 420 can withdraw from the first locking slot 3211 of the first insertion body 321 so as to cause the first insertion member 320 to disengage from the first locking slot 3211; the second locking member 430 can withdraw from the second locking slot 3311 of the second insertion body 331 so as to cause the second inserting member 330 to disengage from the second inserting slot 213.

Figure 10:
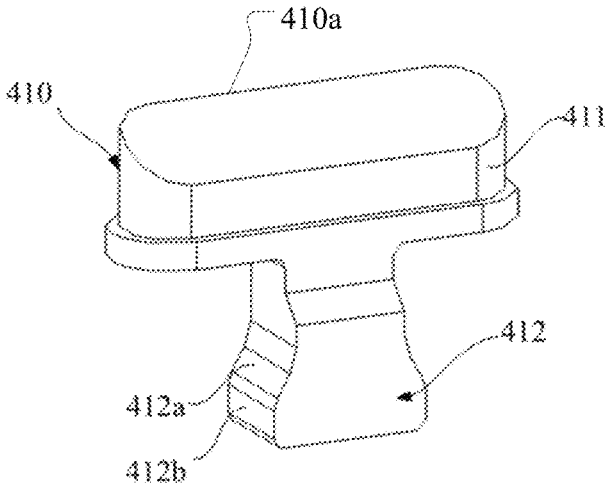
FIG. 10 is a schematic structural view of a movable member in FIG. 9.

In an embodiment, as illustrated in FIGS. 9 and 10, the movable member 410 includes a hand-held portion 411 and an abutting portion 412 connected to the hand-held portion 411. In an embodiment, as illustrated in FIG. 7, the mounting bracket 200 is provided with an avoidance passage 201 defined in the platform 215 and communicating with the accommodation slot 212. In an embodiment, the avoidance passage 201 extends in the thickness direction of the main body 100. When the movable member 410 is attached to the mounting bracket 200, the hand-held portion 411 is movably received in the recessed portion 214 of the mounting bracket 200 located above the platform 215 of the mounting bracket 200, and movably received in the avoidance passage 201. The abutting portion 412 is received in the avoidance passage 201 and the accommodation slot 212. In this way, it is convenient for the user to operate the hand-held portion 411 outside.

In an embodiment, the abutting portion 412 has a width decreasing from an end thereof away from the hand-held portion 411 to an end thereof close to the hand-held portion 411. When the movable member 410 is in the first position, the abutting portion 412 abuts the first locking member 420. When the movable member 410 is in the second position, the first locking member 420 does not contact the abutting portion 412.

In an embodiment, as illustrated in FIG. 9 and FIG. 10, the abutting portion 412 includes a first abutting end 412*a* and a second abutting end 412*b* opposite to the first abutting end 412*a*. The first abutting end 412*a* is connected to the hand-held portion 411. The second abutting end 412*b* is connected to a terminal of the first abutting end 412*a* away from the hand-held portion 411. The first abutting end 412*a* has a width gradually decreasing from the terminal thereof away from the hand-held portion 411 to a terminal thereof close to the hand-held portion 411. It can be understood that, a portion of the first abutting end 412*a* close to the second abutting end 412*b* has a width greater than that of a portion of the first abutting end 412*a* close to the hand-held portion 411. The second abutting end 412*b* has a width remaining the same, greater than or equal to the maximum width of the first abutting end 412*a* in the thickness direction of the main body 100, and greater than a width of the avoidance passage 201. As illustrated in FIG. 13, when the movable member 410 is in the first position, an outer surface of the second abutting end 412*b* abuts the first locking member 420 and the second locking member 430 to drive the first locking member 420 to engage with the first insertion member 320 and drive the second locking member 430 to engage with the second insertion member 330.

Since the first abutting end 412*a* has the width decreasing gradually from the terminal thereof away from the hand-held portion 411 to the terminal thereof close to the hand-held portion 411 in the thickness direction of the main body 100, as illustrated in FIG. 17, when the movable member 410 is moved from the first position to the second position, the hand-held portion 411 is pushed toward the mounting bracket 200 by the user to move the movable member 410 toward the main body 100 in the second direction so as to disengage the second abutting end 412*b* from the first locking member 420 and the second locking member 430. As a result, the first abutting end 412*a* is moved to be located between the first locking member 420 and the second locking member 430 such that the first locking member 420 and the second locking member 430 separate from the outer surface of the first abutting end 412*a*. Thus, a gap is defined between the outer surface of the first abutting end 412*a*, the first locking member 420, and the second locking member 430. At this time, the first locking member 420 can be withdrawn from the first locking slot 3211 and moved into the gap and the second locking member 430 can be withdrawn from the second locking slot 3311 and moved into the gap. Thus, the first locking member 420 can be detached from the first insertion slot 211 and the second locking member 430 can be detached from the second insertion slot 213. Of course, the first locking member 420 can be moved toward the abutting portion 412 rather than withdrawn from the first insertion slot 211 and the second locking member 430 can be moved toward the abutting portion 412 rather than withdrawn from the second insertion slot 213, as long as the first locking member 420 is withdrawn from the first locking slot 3211 and the second locking member 430 is withdrawn from the second locking slot 3311, the band 300 can be detached from the main body 100.

It should be noted that, since the second abutting end 412*b* has the width remaining unchanged in the thickness direction of the main body 100, when the movable member 410 is in the first position, the outer surface of the second abutting end 412*b* which is parallel to the thickness direction of the main body abuts the first locking member 420 so as to strengthen the engagement between the first locking member 420 and the first insertion member 320, thereby preventing the first locking member 420 from disengaging from the first insertion member 320. This is because that the first locking member 420 and the second locking member 430 are abutted by two sides of the second abutting end 412*b* respectively when the movable member 410 is in the first position. As a result, the first locking member 420 and the second locking member 430 cannot roll relative to the second abutting end 412*b*. If the second abutting end 412*b* has the width changing gradually, when the band is drawn by the user, the movable member 410 will bear pressure from the first locking member 420 to drive the second locking member 430 to move in the thickness direction of the band 300, that is, the movable member 410 will be moved from the first position to the second position. Therefore, the second abutting end 412*b* should have the width remaining unchanged in the thickness direction of the band 300 so as to ensure that the band 300 can be stably fixed in the main body 100. The engagement of the second locking member 430 with the movable member 410 and the second locking member 430 is the same as the first locking member 420, and it will not be repeated herein.

In addition to the embodiments described above, the first abutting end 412*a* and the second abutting end 412*b* may have other configurations. In an alternative embodiment, the abutting portion 412 has a width increasing from the end thereof away from the hand-held portion 411 to the end thereof close to the hand-held portion 411. The first abutting end is disposed between the hand-held portion and the second abutting end. The first abutting end has a width being the same and greater than or equal to the maximum width of the second abutting end. The movable member 410 is pulled away from the mounting bracket 200 to move from the first position to the second position. In this embodiment, the second abutting end has a width increasing gradually from the terminal thereof away from the hand-held portion 411 to the terminal thereof close to the hand-held portion 411. It can be understood that, a portion of the second abutting end close to the first abutting end has a width greater than that of a portion of the second abutting end away from the first abutting end. When the movable member 410 is in the first position, the outer surface of the first abutting end will abut the first locking member 420 and the second locking member 430 such that the first locking member 420 is urged to engage with the first insertion member 320 and the second locking member 430 is urged to engage with the second insertion member 330 at the same time.

In this alternative embodiment, since the second abutting end has the width increasing gradually from the terminal thereof away from the hand-held portion 411 to the terminal close to the hand-held portion 411, when the movable member 410 is moved from the first position to the second position, the hand-held portion 411 is pulled away from the mounting bracket 200 to move the movable member 410 toward an outside of the main body 100 in the second direction so as to disengage the first abutting end from the first locking member 420 and the second locking member 430. As a result, the second abutting end is moved to be located between the first locking member 420 and the second locking member 430 such that the first locking member 420 and the second locking member 430 separate from the outer surface of the second abutting end. Thus, a gap is defined between the outer surface of the second abutting end and the first locking member 420 is formed, and a gap between the outer surface of the second abutting end, the first locking member 420, and the second locking member 430. At this time, the first locking member 420 can be withdrawn from the first locking slot 3211 and moved into the gap, and the second locking member 430 can be withdrawn from the second locking slot 3311 and moved into the gap. Thus, the first locking member 420 can be detached from the first insertion slot 211 and the second locking member 430 can be detached from the second insertion slot 213. Of course, the first locking member 420 can be moved toward the abutting portion 412 rather than withdrawn from the first insertion slot 211 and the second locking member 430 can be moved toward the abutting portion 412 rather than withdrawn from the second insertion slot 213, as long as the first locking member 420 is withdrawn from the first locking slot 3211 and the second locking member 430 is withdrawn from the second locking slot 3311, the band 300 can be detached from the main body 100.

It should be noted that, in this alternatively embodiment, since the first abutting end has the width remains unchanged in the thickness direction of the main body 100, when the movable member 410 is in the first position, the outer surface of the first abutting end which is parallel to the thickness direction of the main body abuts the first locking member 420 so as to strengthen the engagement between the first locking member 420 and the first insertion member 320, thereby preventing the first locking member 420 from disengaging from the first insertion member 320. This is because that the first locking member 420 and the second locking member 430 are abutted by two sides of the first abutting end respectively when the movable member 410 is in the first position. As a result, the first locking member 420 and the second locking member 430 cannot roll relative to the first abutting end. If the first abutting end has the width changing gradually, when the band is drawn by the user, the movable member 410 will bear pressure from the first locking member 420 to drive the second locking member 430 to move in the thickness direction of the band 300, that is, the movable member 410 will be moved from the first position to the second position. Therefore, the first abutting end should have the width remaining unchanged in the thickness direction of the band 300 so as to ensure that the band 300 can be stably fixed in the main body 100. The engagement of the second locking member 430 with the movable member 410 and the second locking member 430 is the same as the first locking member 420, and it will not be repeated herein.

In an embodiment, as illustrated in FIGS. 7 and 9, the mounting bracket 200 includes a first slot wall 212*a* defining the first slot portion 2101 of the accommodation slot 212 and a second slot wall 212*b* defining the second slot portion 2102 of the accommodation slot 212. A first opening 2121 is defined in the first slot wall 212 to communicate with the first insertion slot 211. A second opening 2122 is defined in the second slot wall 212*b* to communicate with the second insertion slot 213.

As illustrated in FIG. 13, when the movable member 410 is in the first position, part of the first locking member 420 passes through the first opening 2121 to abut the first insertion member 320, and part of the second locking member 430 passes through the second opening 2122 to abut the second insertion member 330. At this time, the projection of the first locking member 420 on the reference plane partially overlaps the projection of the first insertion end 322 on the reference plane, and the projection of the second locking member 430 on the reference plane partially overlaps the projection of the second insertion end 332 on the reference plane. In an embodiment, as illustrated in FIG. 14, when the movable member 410 is in the first position, part of the first locking member 420 passes through the first opening 2121 to engage in the first locking slot 3211, and part of the second locking member 430 passes through the second opening 2122 to engage in the second locking slot 3311.

As illustrated in FIG. 17, when the movable member 410 is in the second position, the first locking member 420 can be retracted into the first slot portion 2101 of the accommodation slot 212 via the first opening 2121, and the second locking member 430 can be retracted into the second slot portion 2102 of the accommodation slot 212 via the second opening 2122. At this time, the first insertion member 320 is released from the first locking member 420, and the second insertion member 330 is released from the second locking member 430. As a result, the first locking member 420 can be detached from first insertion slot 211, and the second locking member 430 can be detached from the second insertion slot 213.

In an embodiment, the first locking member 420 is spherical or is a ball. The first slot wall 212*a* has a curved surface engaging with an outer surface of the first locking member 420. The first opening 2121 is defined in the curved surface. As illustrated in FIG. 8, the first insertion member 320 forms a curved surface at which the first locking slot 3211 is defined for engaging with the outer surface of the first locking member 420. In this way, when the first locking member 420 engages with the first insertion member 320, the first locking member 420 can move smoothly, and smoothly engage in the first locking slot 3211 of the first insertion member 320. This can avoid concentrating local stresses and thereby prolongs the service life of the mounting and locking mechanism. Additionally, according to certain embodiments, the second abutting end 412*b* can strengthen the engagement between the first locking member 420 and the first insertion member 320, and avoid the detachment of the first locking member 420 from the first insertion member 320. This can be, for example, because the second abutting end 412*b* has a fixed width along the thickness direction of the main body 100. That is, the outer surface of the second abutting end 412*b* is parallel to the thickness direction of the main body 100. In this way, when the first insertion member 320 tends to move away from the first insertion slot 211, the first locking member 420 can tend to move along the curved surface of the first insertion member 320 to disengage from the first insertion member 320 under the movement tendency of the first insertion member 320. However, the movement tendency of the first locking member 420 will be eliminated due to being blocked by the second abutting end 412*b*. Thus, the first locking member 420 will not disengage from the first insertion member 320.

In contrast, if the movable member 410 does not have the second abutting end 412*b*, the first locking member 420 is abutted by the first abutting end 412*a* to engage with the first insertion member 320 when the movable member 410 is in the first position. The first abutting end 412*a* can have a width that decreases gradually from the terminal thereof away from the hand-held portion 411 to the terminal thereof close to the hand-held portion 411. The outer surface of the first abutting end 412*a* may include an inclined wall that is inclined to the thickness relative to the thickness direction of the main body 100. When the first insertion member 320 tends to move away from the first insertion slot 211, the first locking member 420 can accordingly tend to move along the curved surface of the first insertion member 320 to disengage from the first insertion member 320 under the movement tendency of the first insertion member 320, and the first locking member 420 tends to move along the outer surface of the first abutting end 412*a*, that is, the inclined wall of the first abutting end 412*a*. Accordingly, the first locking member 420 can further drive the movable member 410 to move in the thickness direction of the main body 100. As a result, when a driving force is exerted on the first insertion member 320, the first insertion member 320 can easily disengage from the first insertion slot 211 such that there is a risk of the band 300 being detached from the main body 100.

The above configuration of the second abutting end 412*b* of the first locking member 420 can be applicable to the second locking member 430, and it will not be described herein in detail.

In an embodiment, as illustrated in FIG. 9, the locking assembly 400 includes an elastic member 440 disposed between the mounting bracket 200 and the movable member 410. In particularly, the elastic member 440 is disposed between the platform 215 of the mounting bracket 200 and the hand-held portion 411 of the movable member 410. The elastic member 440 may be disposed between the mounting bracket 200 and the hand-held portion 411 in the thickness direction of the main body 100. In an embodiment, the elastic member 440 includes a first elastic element 441. In other embodiments, the elastic member 440 further includes a second elastic element 442. The first elastic element 441 and the second elastic element 442 are symmetrically disposed with respect to the abutting portion 412. The first elastic element 441 and the second elastic element 442 may be springs, sponges, rubbers, or silicones, and it will not be described herein in detail.

As illustrated in FIG. 17, when the movable member 410 is in the second position, the elastic member 440 stores elastic energy. The elastic member 440 can be compressed to store elastic energy, for example, when the hand-held portion 411 is pushed toward the mounting bracket 200 to move the movable member 410 from the first position to the second position. Alternatively, the elastic member 440 can be stretched to store elastic energy, for example, when the hand-held portion 411 is pulled to move the movable member 410 to the second position. When the external force is not applied to the hand-held portion 411, the elastic member 440 may release the elastic energy to move the movable member 410 to the first position such that the band 300 is fixed in the main body 100.

In an embodiment, the second insertion member 330 may be omitted. Accordingly, structures cooperating with the second insertion member 330, such as the second through hole 110*b*, the second insertion slot 213, and the first locking member 420, may be omitted. In other words, the end of the band body 310 is only provided with the first insertion member 320. At this time, the first insertion member 320 is inserted into the first insertion slot 211 to engage with the first locking member 420 such that the band 300 is fixed in the main body 100. The implementation in which only the first insertion member 320 is applied is the same as the implementation in which the first insertion member 320 and the second insertion member 330 are included, and it will not be repeated herein.

In an embodiment, as illustrated in FIGS. 4 and 13, the rear cover 130 is provided with a through slot 131 communicating with the accommodation slot 21. The through slot 131 is operated to allow the movable member 410 to pass through. The hand-held portion 411 of the movable member 410 is provided an inclined outer surface 410*a* at a top wall of the hand-held portion 411. When the movable member 410 is in the first position, the inclined outer surface 410*a* of the movable member 410 is flush with an outer surface 130*a* of the rear cover 130. In this way, when the band 300 is fixed in the main body 100, the appearance of the main body 100 can be maintained and beautified.

The technical features of the embodiments described above can be arbitrarily combined. In order to simplify the description, all possible combinations of the technical features in the above embodiments have not been described. However, as long as there is no contradiction in the combination of these technical features, the combination of these technical features should be considered to be within the scope described in present disclosure.

The present disclosure describes certain embodiments in a more specific and detailed manner, but not should be read to limit the scope of the present disclosure. It should be noted that modifications and improvements can be made by those skilled in the art within the spirit and principle of the above embodiments, and those modifications and improvement should be included within the scope of protection of the present disclosure. Therefore, the scope of the present disclosure shall be subject to the appended claims.

What is claimed is:

1. A mounting and locking mechanism, comprising:

a mounting bracket provided with a mounting space, the mounting space comprising a first insertion slot and an accommodation slot, the accommodation slot having a first slot wall, the first slot wall provided with a first opening communicating with the first insertion slot; and a locking assembly comprising a movable member and a first locking member, the movable member received in the accommodation slot, the first locking member being capable of contacting the first slot wall, the movable member movable between a first position and a second position;

wherein when the movable member is in the first position, the movable member abuts the first locking member to drive part of the first locking member to pass through the first opening to be positioned in the first insertion slot;

wherein when the movable member is in the second position, the first locking member is capable of being withdrawn from the first insertion slot.

2. The mounting and locking mechanism of claim 1, wherein the movable member comprises a hand-held portion and an abutting portion connected to the hand-held portion;

wherein the abutting portion has a width decreasing from an end thereof away from the hand-held portion to an end thereof close to the hand-held portion in a direction perpendicular to a movement direction of the movable member;

wherein when the movable member is in the first position, the abutting portion abuts the first locking member.

3. The mounting and locking mechanism of claim 2, wherein the abutting portion comprises a first abutting end and a second abutting end opposite to the first abutting end, the first abutting end is connected to the hand-held portion, the second abutting end is connected to a terminal of the first abutting end away from the hand-held portion;

wherein the first abutting end has a width decreasing from the terminal thereof away from the hand-held portion to a terminal thereof close to the hand-held portion in the direction perpendicular to the movement direction of the movable member;

wherein the second abutting end has a width being the same and greater than or equal to the maximum width of the first abutting end in the direction perpendicular to the movement direction of the movable member;

wherein when the movable member is in the first position, the second abutting end abuts the first locking member.

4. The mounting and locking mechanism of claim 2, wherein the mounting bracket is provided with an avoidance passage communicating with the accommodation slot, the hand-held portion extends out of the avoidance passage, and the abutting portion is received in the avoidance passage and the accommodation slot.

5. The mounting and locking mechanism of claim 1, wherein a shape of the first locking member is spherical, the first slot wall has a curved surface engaging with an outer surface of the first locking member, and the first opening is defined in the curved surface.

6. The mounting and locking mechanism of claim 1, wherein the mounting space further comprises a second insertion slot disposed at a side of the mounting space away from the first insertion slot, the accommodation slot has a second slot wall, a second opening is defined in the second slot wall and communicated with the second insertion slot, the locking assembly comprises a second locking member capable of contacting the second slot wall;

wherein when the movable member is in the first position, the movable member abuts the second locking member to drive part of the second locking member to pass through the second opening to be positioned in the second insertion slot;

wherein when the movable member is in the second position, the second locking member is capable of being withdrawn from the second insertion slot.

7. The mounting and locking mechanism of claim 6, wherein the movable member comprises a hand-held portion and an abutting portion connected to the hand-held portion;

wherein the abutting portion comprises a first abutting end and a second abutting end opposite to the first abutting end, the first abutting end is connected between the hand-held portion and the second abutting end;

wherein the first abutting end of the abutting portion has a width decreasing from a terminal thereof away from the hand-held portion to a terminal thereof close to the hand-held portion while the second abutting end of the abutting portion has a width being the same and greater than or equal to the maximum width of the first abutting end in the direction perpendicular to the movement direction of the movable member;

wherein the first abutting end of the abutting portion abuts the first locking member and the second locking member when the movable member is in the first position, or the second abutting end of the abutting portion has a width increasing from a terminal thereof away from the hand-held portion to a terminal thereof close to the hand-held portion in a direction perpendicular to a movement direction of the movable member while the first abutting end of the abutting portion has a width being the same and greater than or equal to the maximum width of the second abutting end in the direction perpendicular to the movement direction of the movable member;

wherein the second abutting end of the abutting portion abuts the first locking member and the second locking member when the movable member is in the first position.

8. The mounting and locking mechanism of claim 1, wherein the locking assembly comprises an elastic member disposed between the mounting bracket and the movable member, wherein the elastic member stores elastic energy when the movable member is in the second position, and the elastic member releases the elastic energy to move the movable member to the first position.

9. The mounting and locking mechanism of claim 1, wherein the first slot wall has a curved surface engaging with an outer surface of the first locking member, the first opening is defined in the curved surface.

10. A casing, comprising:

a main body; and a mounting and locking mechanism comprising:

a mounting bracket, provided with a mounting space, the mounting space comprising a first insertion slot and an accommodation slot, the accommodation slot having a first slot wall, the first slot wall provided with a first opening communicating with the first insertion slot; and a locking assembly, comprising a movable member and a first locking member, the movable member received in the accommodation slot, the first locking member being capable of contacting the first slot wall, the movable member being movable between a first position and a second position, wherein when the movable member is in the first position, the movable member abuts the first locking member to drive part of the first locking member to pass through the first opening to be positioned in the first insertion slot;

wherein when the movable member is in the second position, the first locking member is capable of being withdrawn from the first insertion slot;

wherein the mounting bracket is attached to the main body, and a movement direction of the movable member is parallel to a thickness direction of the main body.

11. The casing of claim 10, wherein the main body comprises a middle frame and a rear cover, the mounting bracket is mounted in the middle frame, the rear cover is attached to the mounting bracket, the rear cover is provided with a through slot for the movable member extending therethrough, the hand-held portion of the movable member is provided with an inclined outer surface at a top wall of the hand-held portion, when the movable member is in the first position, the inclined outer surface of the movable member is flush with an outer surface of the rear cover.

12. The casing of claim 10, wherein a shape of the first locking member is spherical, the first slot wall has a curved surface engaging with an outer surface of the first locking member, and the first opening is defined in the curved surface.

13. A wearable device, comprising:

a main body;

a band, comprising a band body and a first insertion member attached to one end of the band body, wherein the first insertion member is provided with a first locking slot, and the first insertion member is capable of being inserted into the main body in a length direction of the band;

a locking assembly, comprising a movable member and a first locking member, the movable member attached to the main body and being movable between a first position and a second position in a thickness direction of the band;

wherein when the movable member is in the first position, the movable member abuts the first locking member to drive the first locking member to be positioned in the first locking slot;

wherein when the movable member is in the second position, the first locking member is capable of being withdrawn from the first locking slot such that the first insertion member is capable of being detached from the main body.

14. The wearable device of claim 13, wherein the main body is provided with a first insertion slot and an accommodation slot communicating with the first insertion slot, the first insertion member is capable of engaging in the first insertion slot;

wherein the movable member is accommodated in the accommodation slot, the movable member comprises a hand-held portion and an abutting portion connected to the hand-held portion, wherein the abutting portion comprises a first abutting end and a second abutting end opposite to the first abutting end, the first abutting end is connected between the hand-held portion and the second abutting end;

wherein the second abutting end of the abutting portion has a width increasing from a terminal thereof away from the hand-held portion to a terminal thereof close to the hand-held portion while the first abutting end of the abutting portion has a width being the same and greater than or equal to the maximum width of the second abutting end in the direction perpendicular to the movement direction of the movable member;

wherein the first locking member is clamped between the first insertion member and first abutting end of the abutting portion, or the first abutting end of the abutting portion has a width decreasing from a terminal thereof away from the hand-held portion to a terminal thereof close to the hand-held portion in a width direction of the band;

wherein the first locking member is clamped between the first insertion member and the second abutting end of the abutting portion when the movable member is in the first position.

15. The wearable device of claim 14, wherein the main body is provided with an avoidance passage communicating with the accommodation slot, the avoidance passage extends in a thickness direction of the main body, the hand-held portion extends out of the avoidance passage, the abutting portion is received in the avoidance passage and the accommodation slot.

16. The wearable device of claim 14, wherein the accommodation slot has a first slot wall, a first opening is defined in the first slot wall to communicate with the first insertion slot;

wherein when the movable member is in the first position, part of the first locking member passes through the first opening to be positioned in the first insertion slot.

17. The wearable device of claim 14, further comprising a second locking member, wherein the band further comprises a second insertion member disposed at the end of the band body where the first insertion member is disposed, the first insertion member and the second insertion member are disposed in a width direction of the band body, the second insertion member is provided with a second locking slot, the main body is provided with a second insertion slot communicating with the accommodation slot, the second insertion member is capable of inserting into the second insertion slot in a length direction of the band;

wherein when the movable member is in the first position, the movable member abuts the second locking member to drive the second locking member to be positioned in the second locking slot;

wherein when the movable member is in the second position, the second locking member is capable of being withdrawn from the second locking slot so as to allow the second insertion member to be detached from the main body.

18. The wearable device of claim 17, wherein the accommodation slot has a first slot wall and a second slot wall, a first opening is defined in the first slot wall and communicated with the first insertion slot, a second opening is defined in the second slot wall and communicated with the second insertion slot, when the movable member is in the first position, part of the first locking member passes through the first opening to be positioned in the first locking slot of the band, and part of the second locking member passes through the second opening to be positioned in the second locking slot of the band.

19. The wearable device of claim 18, wherein the main body comprises a middle frame, a mounting bracket, and a rear cover, the mounting bracket and the rear cover are attached to the middle frame, the rear cover is attached to the mounting bracket, wherein the first insertion slot, the second insertion slot, and the accommodation slot are defined in the mounting bracket, the rear cover is provided with a through slot for the movable member extending therethrough, when the movable member is in the first position, an outer surface of the movable member is flush with an outer surface of the rear cover.

20. The wearable device of claim 13, wherein a shape of the first locking member is spherical, the first slot wall has a curved surface engaging with an outer surface of the first locking member, and the first opening is defined in the curved surface.

* * * * *